US009125448B2

(12) United States Patent
Klotz et al.

(10) Patent No.: US 9,125,448 B2
(45) Date of Patent: Sep. 8, 2015

(54) SUPPORT FOR VISORS AND FACE SHIELDS

(71) Applicants: Robert E. Klotz, Jefferson Hills, PA (US); James R. Tomlinson, Pittsburgh, PA (US); Matthew C. Miller, Pittsburgh, PA (US)

(72) Inventors: Robert E. Klotz, Jefferson Hills, PA (US); James R. Tomlinson, Pittsburgh, PA (US); Matthew C. Miller, Pittsburgh, PA (US)

(73) Assignee: MSA TECHNOLOGY, LLC, Cranberry Township, PA (US)

( * ) Notice: Subject to any disclaimer, the term of this patent is extended or adjusted under 35 U.S.C. 154(b) by 0 days.

(21) Appl. No.: 14/012,601

(22) Filed: Aug. 28, 2013

(65) Prior Publication Data

US 2014/0352040 A1 Dec. 4, 2014

Related U.S. Application Data

(60) Provisional application No. 61/829,033, filed on May 30, 2013.

(51) Int. Cl.
*A42B 3/22* (2006.01)
*A42B 3/00* (2006.01)

(52) U.S. Cl.
CPC ..... *A42B 3/221* (2013.01); *A42B 3/225* (2013.01)

(58) Field of Classification Search
CPC ..... A42B 3/225; A42B 3/22; A42B 3/04; A42B 3/222; A42B 3/223; E05D 11/105; E05D 11/1078; E05D 11/04; E05D 11/082; A41D 13/1161; A41D 13/1184
See application file for complete search history.

(56) References Cited

U.S. PATENT DOCUMENTS

| | | | | |
|---|---|---|---|---|
| 4,109,320 | A * | 8/1978 | Anderson | 2/10 |
| 4,479,738 | A * | 10/1984 | Kubnick | 403/329 |
| 5,008,976 | A * | 4/1991 | Busch | 16/276 |
| 5,185,889 | A * | 2/1993 | Kamata | 2/424 |
| 5,950,245 | A | 9/1999 | Binduga | |
| 5,987,651 | A * | 11/1999 | Tanaka | 2/424 |
| 6,041,435 | A | 3/2000 | Paulson | |
| 6,260,197 | B1 | 7/2001 | Hoogewind | |
| 6,264,392 | B1 * | 7/2001 | Wise et al. | 403/112 |
| 6,807,679 | B1 * | 10/2004 | Wang-Lee | 2/10 |
| 7,077,128 | B2 * | 7/2006 | Wilson et al. | 128/201.24 |
| 7,103,937 | B2 * | 9/2006 | Weng | 16/273 |
| 7,222,395 | B2 * | 5/2007 | Vackar | 16/330 |
| 7,607,201 | B2 * | 10/2009 | Lin | 16/330 |
| 7,665,185 | B2 * | 2/2010 | Vackar | 16/330 |
| 8,151,375 | B2 * | 4/2012 | Taccioli et al. | 2/429 |
| 8,161,576 | B2 * | 4/2012 | Lemke et al. | 2/418 |

(Continued)

FOREIGN PATENT DOCUMENTS

WO WO2014193627 12/2014

*Primary Examiner* — Bobby Muromoto, Jr.
(74) *Attorney, Agent, or Firm* — Bartony & Associates, LLC

(57) ABSTRACT

A support system includes a headwear system, a frame adapted to have a visor attached thereto, a first member attached to the headwear system, a second member attached to the frame, which is pivotable relative to the first member, an adjustable mechanism adapted to abut and apply force to the second member in a first state to compress the second member into abutting engagement with the first member, an extending pivot member extending axially through a passage in the first member and a passage in the second member. The position of the adjustable mechanism is adjustable to place it in the first state or in at least a second, nonabutting state. The extending pivot member includes a first flange and a second flange, spaced from the first flange to capture a portion of the first member and a portion of the second member therebetween.

26 Claims, 9 Drawing Sheets

(56) References Cited

U.S. PATENT DOCUMENTS

| | | | | |
|---|---|---|---|---|
| 8,214,920 | B1 * | 7/2012 | Edgar et al. | 2/8.2 |
| 8,225,419 | B2 * | 7/2012 | Hersick et al. | 2/5 |
| 8,434,168 | B2 * | 5/2013 | Paulson | 2/427 |
| 8,539,613 | B2 * | 9/2013 | Hersick et al. | 2/5 |
| 2004/0199982 | A1 | 10/2004 | Wang-Lee | |
| 2011/0072548 | A1 * | 3/2011 | Hersick et al. | 2/5 |
| 2012/0278963 | A1 * | 11/2012 | Hersick et al. | 2/5 |

* cited by examiner

SUPPORT FOR VISORS AND FACE SHIELDS

CROSS-REFERENCE TO RELATED APPLICATIONS

This application claims benefit of U.S. Provisional Patent Application Ser. No. 61/829,033, filed May 30, 2013, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Face shields or visors are used in many industries, professions and/or fields (for example, the chemical, the medical, the construction, and the manufacturing fields) to protect a user's eyes and face from various hazards. A face shield or visor is typically supported upon a user's head by a headwear support system which may for example, include a headband, visor frame, or helmet, or another type of support system. During use, the face shield or visor is attached to be positioned in front of the user's face. In many support systems, the face shield or visor may pivot from, for example, a lowered (in-use) position to an upward (stowed) position.

A number of problems arise with current support systems including adjustment mechanisms to adjust the position of a face shield or visor. For example, such mechanisms may be overly complex and difficult to manufacture or operate. Often adjustment knobs are used which may become loose and/or disengaged from the remainder of the system, leading to lost elements and difficult reassembly tasks. Moreover, some adjustable mounting systems do not provide for smooth adjustment of position and/or adequate maintenance of a desired position.

SUMMARY

In one aspect, a support system includes a headwear system adapted to be worn on the head of a user, a frame adapted to have a visor attached thereto to shield at least a portion of the face of the user, a first member attached to the headwear system, and a second member attached to the frame. The second member is pivotable relative to the first member so that the frame is pivotable relative to the headwear system. The support system further includes an adjustable mechanism adapted to abut and apply force to the second member in a first state to compress the second member into abutting engagement with the first member. The adjustable mechanism further has at least a second state in which the adjustable mechanism does not abut the first member. The support system further includes an extending pivot member extending axially through a passage in the first member and a passage in the second member. The extending pivot member includes threading, and the adjustable mechanism includes cooperating threading via which the position of the adjustable mechanism may be adjusted to place it in the first state or in the at least a second state. The extending pivot member further may include a first flange and a second flange, spaced from the first flange. The first flange and the second flange capture a portion of the first member and a portion of the second member therebetween, thereby maintaining the extending pivot member, the first member and the second in operative connection.

The extending pivot member may, for example, further include a third flange. The threading of the extending pivot member may be positioned between the third flange and the second flange. The third flange cooperates with a portion of the adjustable mechanism to retain the adjustable mechanism in operative connection with the first member and the second member. In a number of embodiments, at least 10 pounds of force is required to separate the adjustable mechanism and the extending pivot member. The adjustable mechanism may, for example, include a passage through which the third flange of the extending pivot member is press fit to a position in which the third flange of the extending pivot member cooperates with a radially inward extending portion of the extending pivot member.

In a number of embodiments, the third flange is positioned relative to the threading of the extending pivot member such that the cooperating threading of the adjustable mechanism can be removed from connection with the threading of the extending pivot member while the adjustable mechanism is retained in connection with the extending pivot member via cooperation of the third flange and the radially inward extending portion of the adjustable mechanism. The first member may, for example, include a guide member, and the adjustable mechanism may, for example, include a cooperating guide member such that the guide member cooperates with the cooperating guide member to maintain the adjustable mechanism in general axial alignment with the extending pivot member when the cooperating threading of the adjustable mechanism is removed from connection with the threading of the extending pivot member. In a number of embodiments, the guide member and the cooperating guide member are each annular in shape.

The first member may, for example, include a hub having an axially extending member. The second member may, for example, include a collar that extends around at least a portion of the axially extending member. A surface of the extending member of the hub may, for example, be angled, and an inner diameter of the collar may, for example, be angled.

In a number of embodiments, the first member and the second are maintained in operative connection via the extending pivot member such that force must be applied to the frame when the adjustable mechanism is in the second state to pivot the frame relative to the headwear system.

In another aspect, a support system includes a headwear system adapted to be worn on the head of a user, a frame adapted to have a visor attached thereto to shield at least a portion of the face of the user, a hub attached to one of the headwear system or the frame, wherein the hub includes an axially extending member, and a collar attached to the other of the headwear system or the frame. The collar extends around at least a portion of the axially extending member of the hub and is pivotable about the axis of the axially extending member of the hub. The support system further includes an adjustable mechanism adapted to abut and apply force to one of the collar or the hub in a first state to compress the inner wall of the collar into abutting engagement with the axially extending member of the hub. The adjustable mechanism further has at least a second state in which the adjustable mechanism does not abut the collar or the hub. In a number of embodiments, the hub is attached to the headwear system such that the axially extending member of the hub extends axially outward (away from the head of the user with the support system is worn by the user), and the collar is attached to the frame. An outer surface of the axially extending member of the hub may, for example, be angled, and an inner diameter of the collar may, for example, be angled.

In a number of embodiments, the support system further includes an extending pivot member extending axially through a passage in the hub and a passage in the collar. The extending pivot member includes threading, and the adjustable mechanism includes cooperating threading via which the position of the adjustable mechanism may be adjusted to place it in the first state or in the at least a second state. The extending pivot member may further include a first flange and a second flange, spaced from the first flange. The first flange and the second flange may, for example, capturing a portion of the hub and a portion of the collar therebetween, thereby maintaining the extending pivot member, the hub and the frame in operative connection.

In a number of embodiments, the extending pivot member further includes a third flange, wherein the threading of the extending pivot member is positioned between the third flange and the second flange. The third flange cooperates with a portion of the adjustable mechanism to retain the adjustable mechanism in operative connection with the hub and the frame. In a number of embodiments, at least 10 pounds of force is required to separate the adjustable mechanism and the extending pivot member. The adjustable mechanism may, for example, include a passage through which the third flange of the extending pivot member is press fit to a position in which the third flange of the extending pivot member cooperates with a radially inward extending portion of the extending pivot member. The third flange may, for example, be positioned relative to the threading of the extending pivot member such that the cooperating threading of the adjustable mechanism can be removed from connection with the threading of the extending pivot member while the adjustable mechanism is retained in connection with the extending pivot member via cooperation of the third flange and the radially inward extending portion of the adjustable mechanism.

In a number of embodiments, the collar includes a guide member, and the adjustable mechanism includes a cooperating guide member such that the guide member cooperates with the cooperating guide member to maintain the adjustable mechanism in general axial alignment with the collar when the cooperating threading of the adjustable mechanism is removed from connection with the threading of the extending pivot member. The guide member and the cooperating guide member may, for example, each be annular in shape.

In a number of embodiments, the extending pivot member includes an element that abuts with a cooperating element of the collar so that the pivot member pivots with the frame. The element of the extending pivot member may, for example, be the second flange. The second flange may, for example, have a noncircular shape, and the cooperating element may, for example, be a seating of the collar which has a noncircular shape.

In a number of embodiments, the first member and the second are maintained in operative connection via the extending pivot member such that force must be applied to the frame when the adjustable mechanism is in the second state to pivot the frame relative to the headwear system.

In a further aspect, a support system includes a headwear system adapted to be worn on the head of a user, a frame adapted to have a visor attached thereto to shield at least a portion of the face of the user, a first member attached to the headwear system and a second member attached to the frame. The second member is pivotable relative to the first member so that the frame is pivotable relative to the headwear system. The support system further includes an adjustable mechanism adapted to abut and apply force to the second member in a first state to compress the second member into abutting engagement with the first member. The adjustable mechanism also has at least a second state in which the adjustable mechanism does not abut the first member. The support system further includes an extending pivot member extending axially through a passage in the first member and a passage in the second member. The extending pivot member includes threading, and the adjustable mechanism includes cooperating threading via which the position of the adjustable mechanism may be adjusted to place it in the first state or in the at least a second state. The extending pivot member further includes a retaining flange that cooperates with a portion of the adjustable mechanism to retain the adjustable mechanism in operative connection with the extending pivot member. The adjustable mechanism includes a passage through which the retaining flange is press fit to a position in which the retaining flange of the extending pivot member cooperates with a radially inward extending portion of the extending pivot member. In a number of embodiments, at least 10 pounds of force is required to separate the adjustable mechanism and the extending pivot member.

The present devices, systems, and methods, along with the attributes and attendant advantages thereof, will best be appreciated and understood in view of the following detailed description taken in conjunction with the accompanying drawings.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "an adjustable mounting system" includes a plurality of such adjustable mounting systems and equivalents thereof known to those skilled in the art, and so forth, and reference to "the adjustable mounting system" is a reference to one or more such adjustable mounting systems and equivalents thereof known to those skilled in the art, and so forth.

Figure 4A:
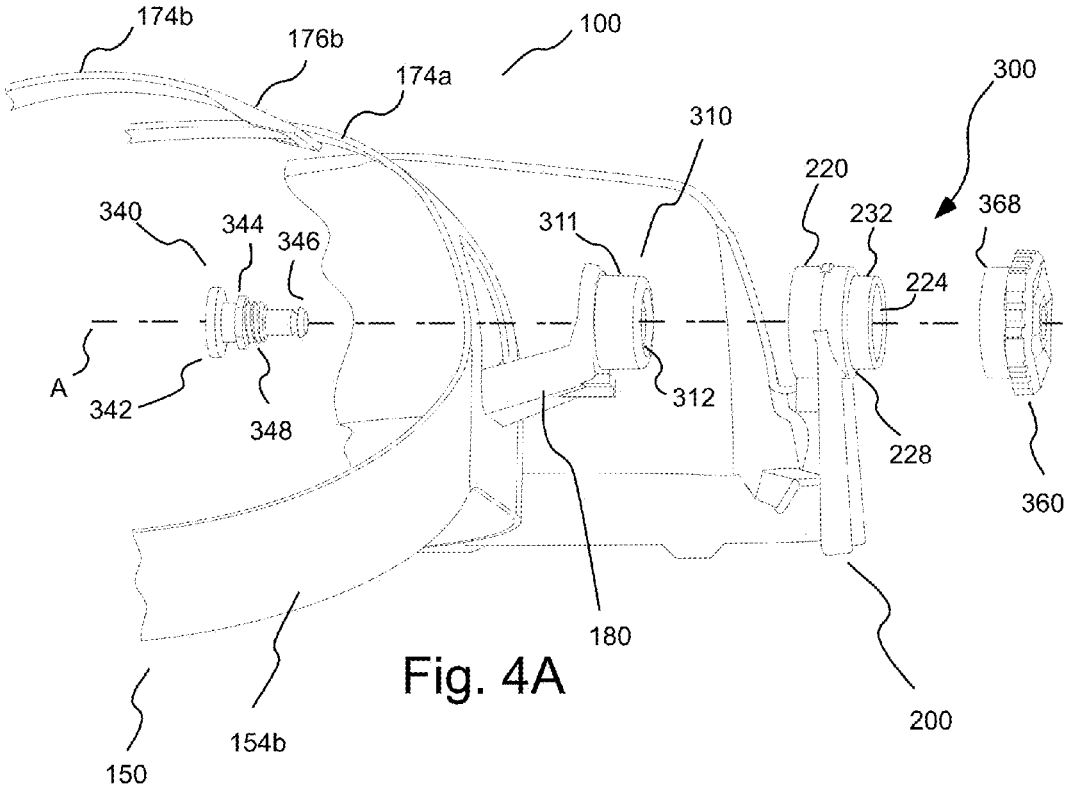
FIG. 4A illustrates a perspective, exploded or disassembled view of a portion of the support system of FIG. 1 including an adjustable mounting system thereof.
Figure 4B:
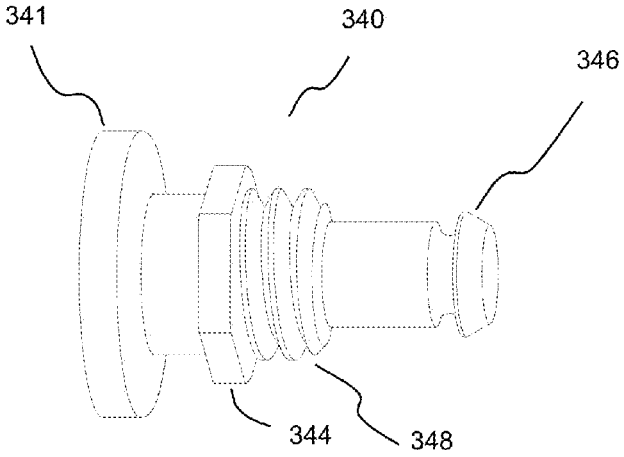
FIG. 4B illustrates an enlarged perspective view of an extending pivot member of an adjustable mounting system of the suspension system of FIG. 1.
Figure 4C:
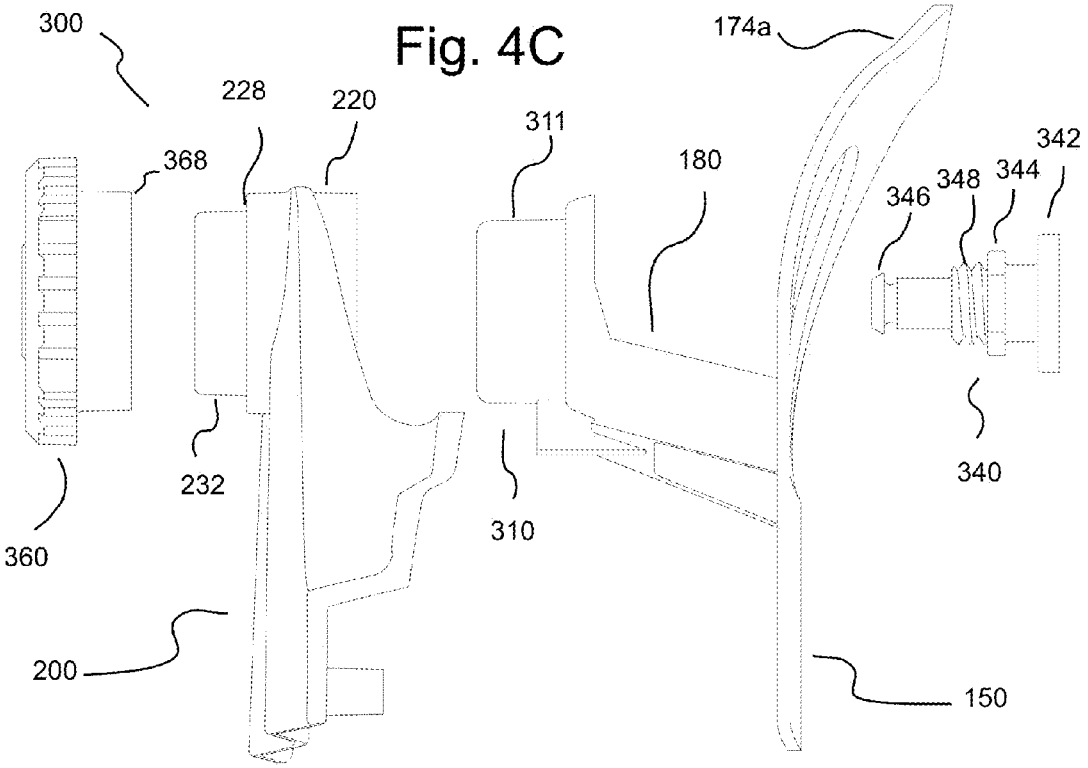
FIG. 4C illustrates a side exploded or disassembled view of a portion of the adjustable mounting system of the support system of FIG. 1.
Figure 4D:
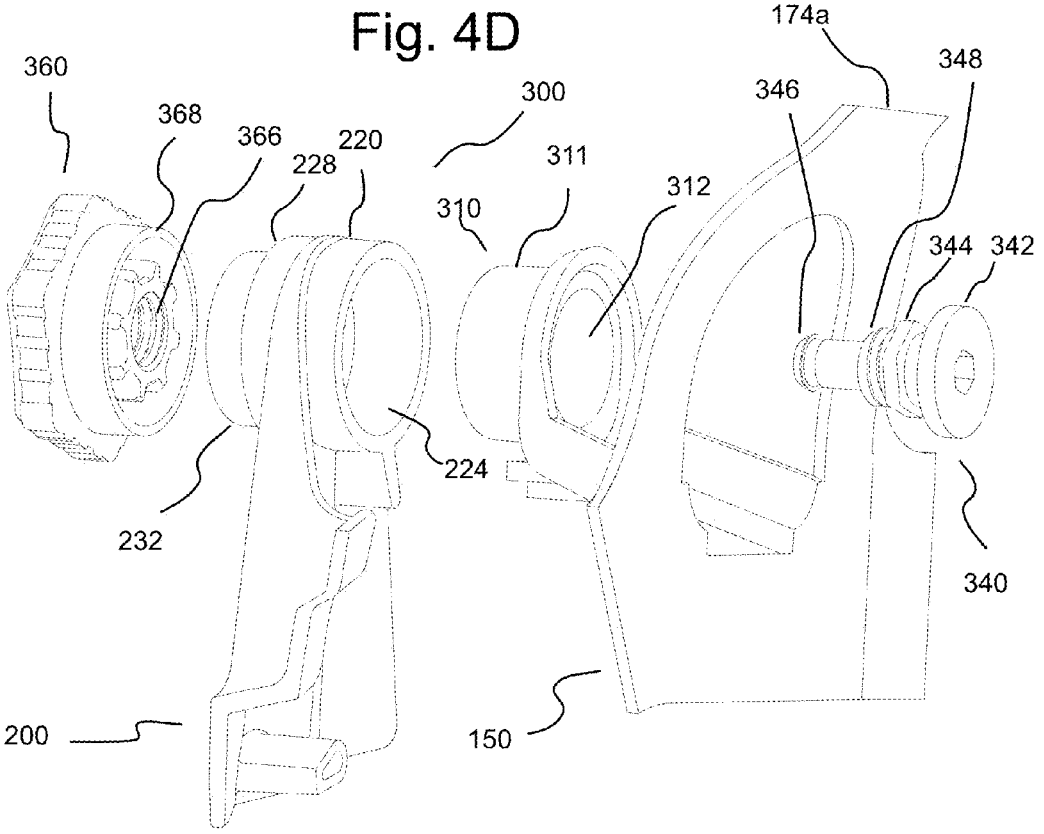
FIG. 4D illustrates another perspective, exploded or disassembled view of the adjustable mounting system of the support system of FIG. 1.
Figure 5A:
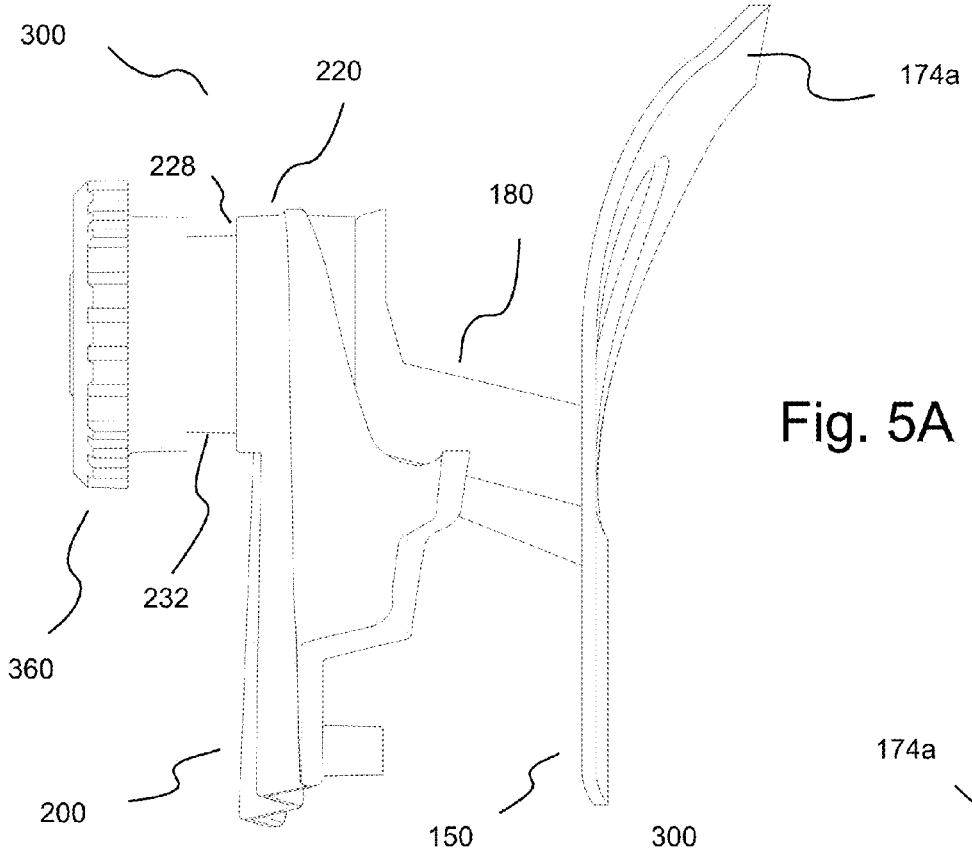
FIG. 5A illustrates a side view of the adjustable mounting system of the support system of FIG. 1 wherein an adjustment mechanism or knob is in a loosened state.
Figure 5B:
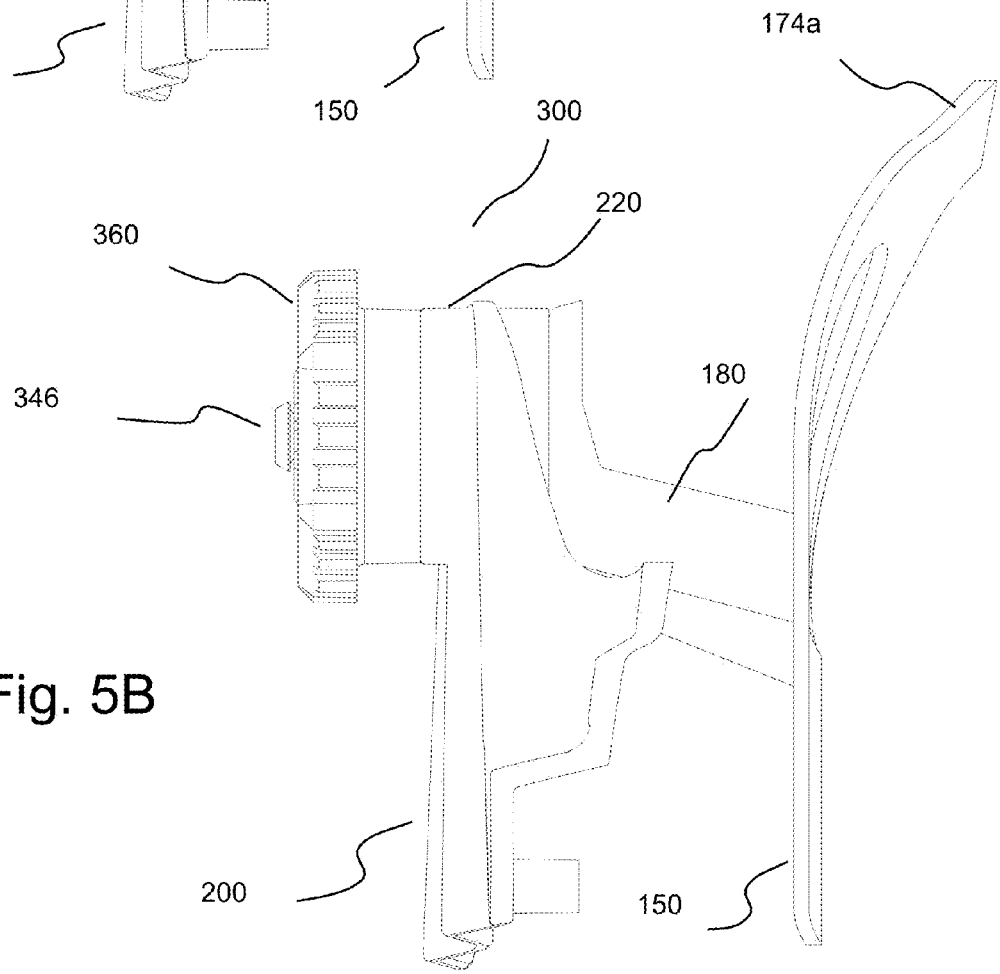
FIG. 5B illustrates a side view of the adjustable mounting system of the support system of FIG. 1 wherein an adjustment knob is in a tightened or locked state.
Figure 5C:
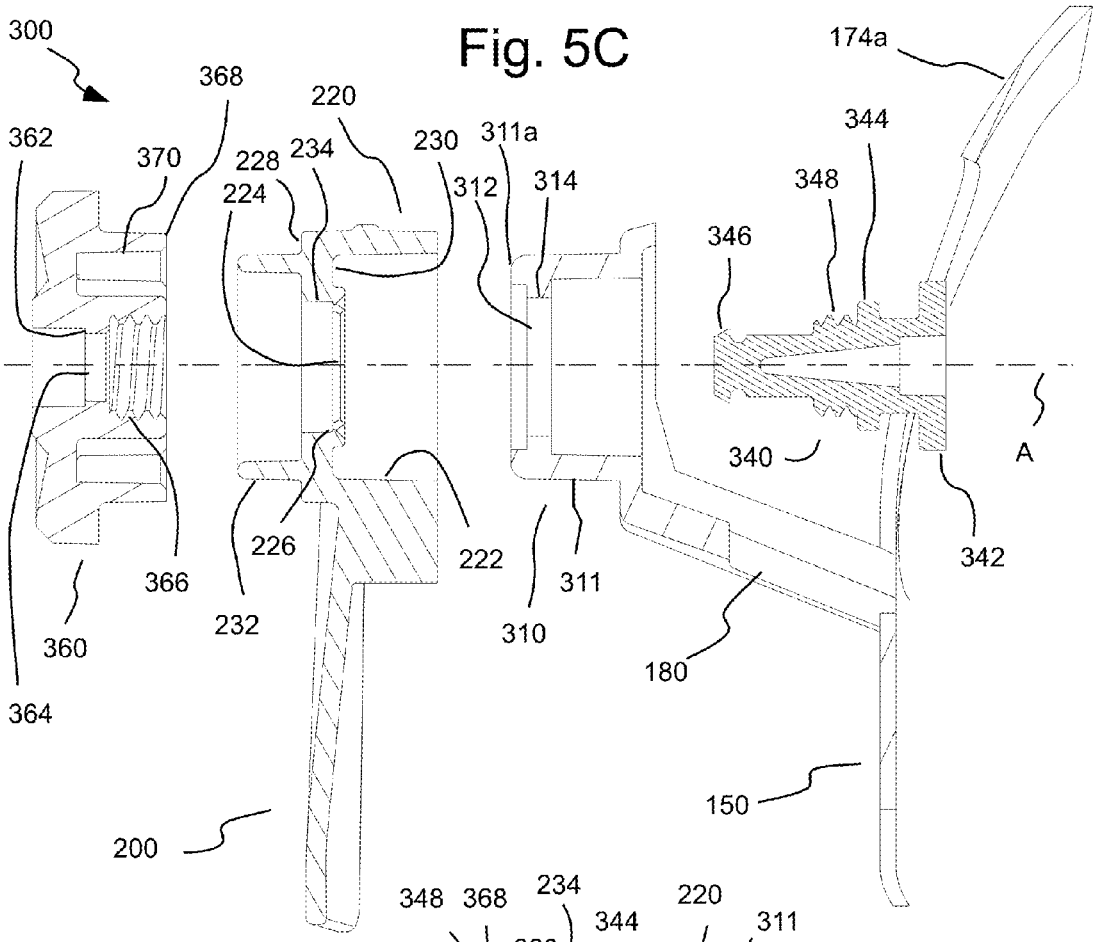
FIG. 5C illustrates a side, cross-sectional exploded or disassembled view of the adjustable mounting system of the support system of FIG. 1.
Figure 5D:
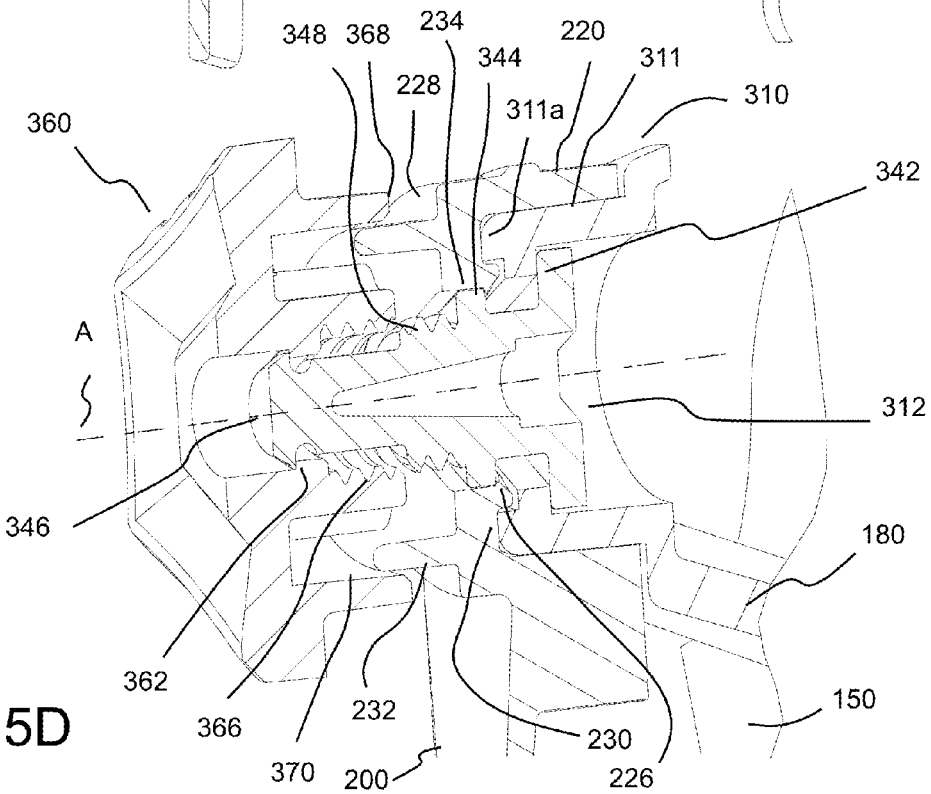
FIG. 5D illustrates a perspective cutaway view of the adjustable mounting system of the support system of FIG. 1.
Figure 5E:
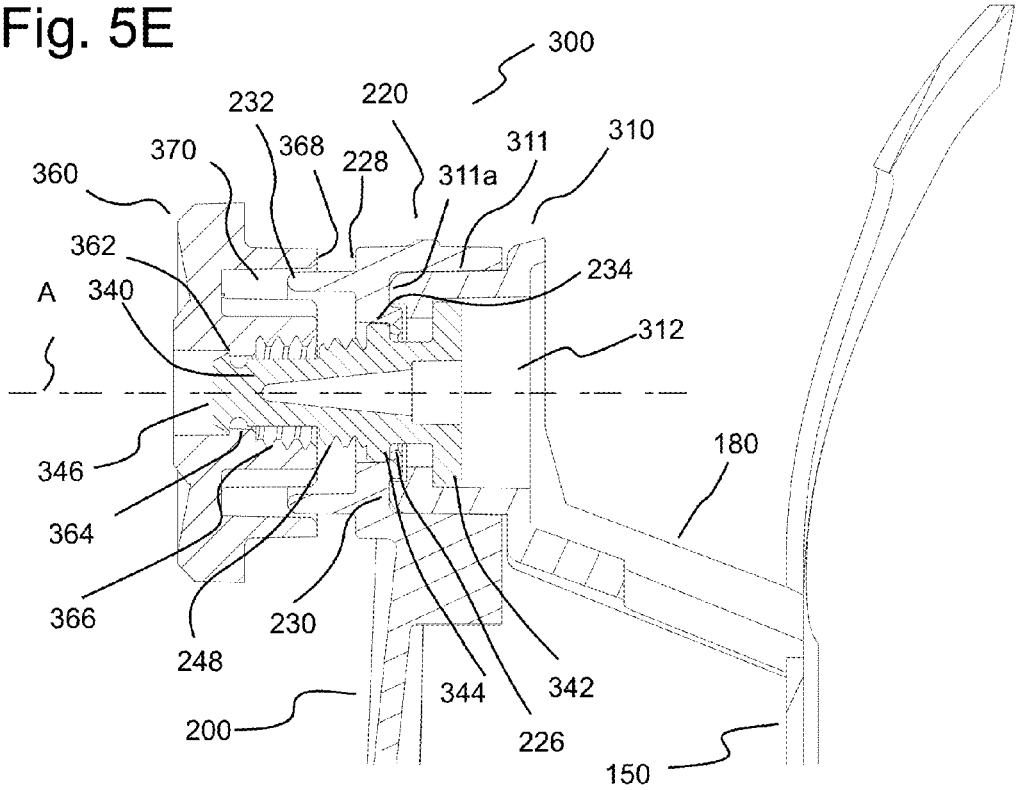
FIG. 5E illustrates a side, cutaway view of the adjustable mounting system of the support system of FIG. 1 in an assembled state wherein the adjustment knob is in a loosened state.
Figure 5F:
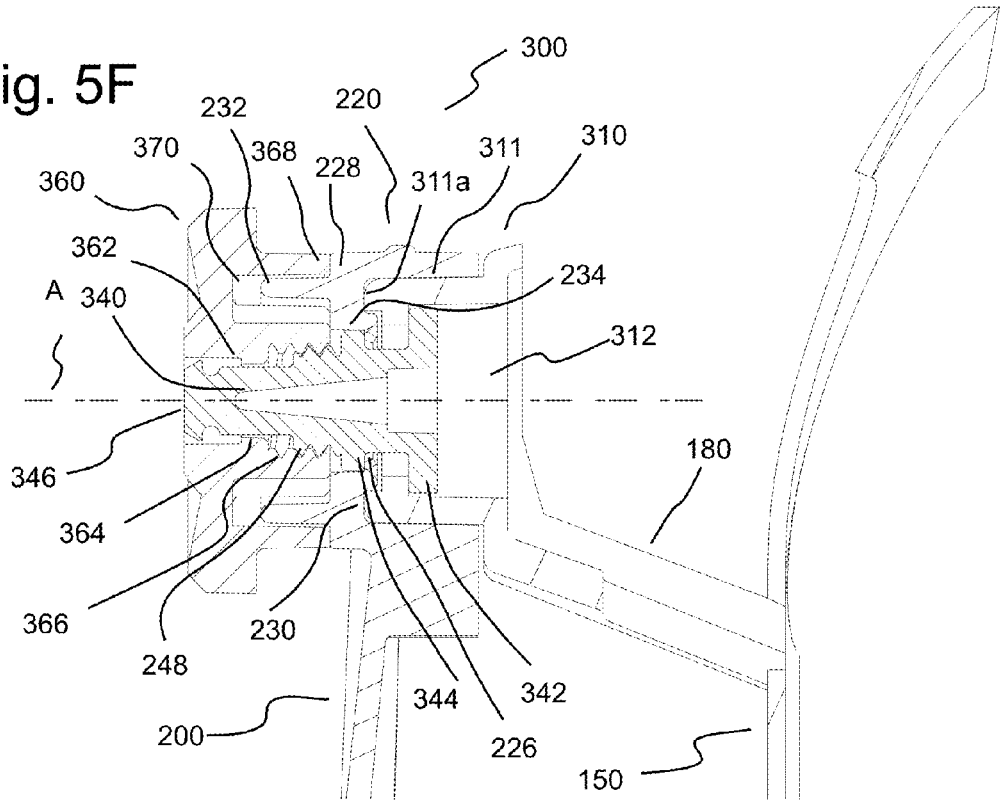
FIG. 5F illustrates a side, cutaway view of the adjustable mounting system of the support system of FIG. 1 in an assembled state wherein the adjustment knob is in a tightened or locked state.

As used herein, terms such as "inward", "outward" and like terms refer generally to directions associated with support systems hereof as worn on the head of a user unless the context dictates otherwise. As used herein as a convention in connection with adjustable mounting mechanisms hereof, the terms "axial", "axially" and related terms refer generally to, for example, an axis A (or a similar axis—see, for example, FIG. 4A) around which a such an adjustable mounting system may be formed (although not necessarily symmetrically therearound) and to directions collinear with or parallel to such an axis. The terms "radial", "radially" and related terms refer generally to a direction generally perpendicular to an axis such as axis A.

Figure 1:
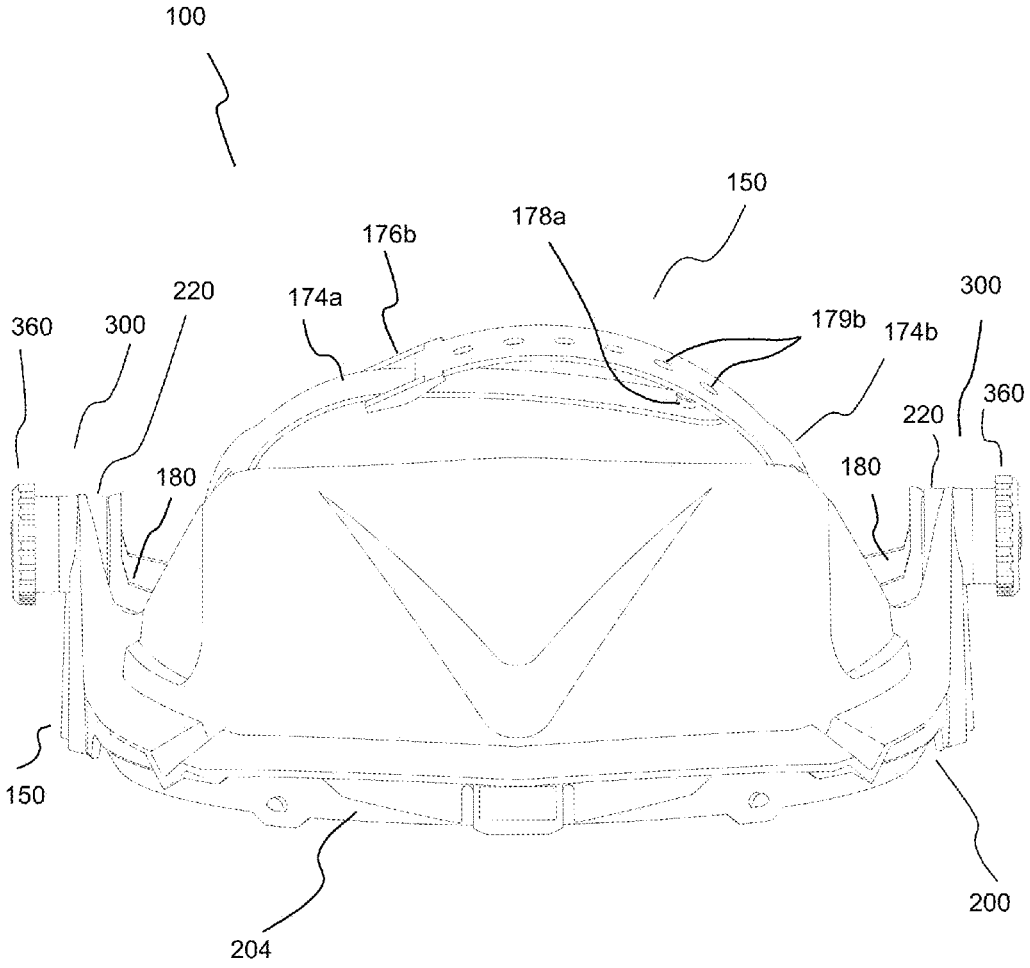
FIG. 1 illustrates a front view of a support system hereof including a pivotable frame for a face shield or visor.
Figure 2:
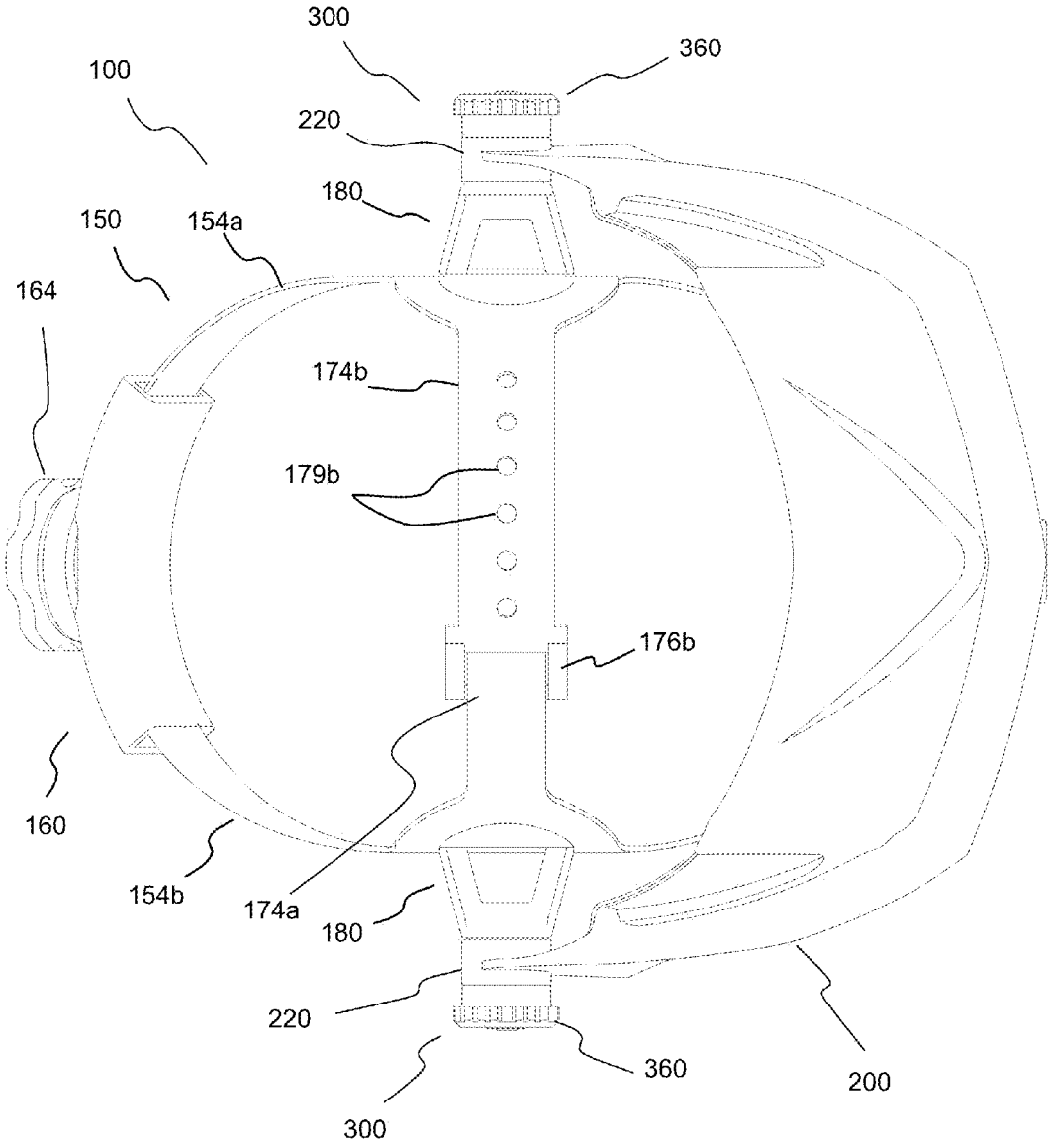
FIG. 2 illustrates a top view of the support system of FIG. 1.
Figure 3A:
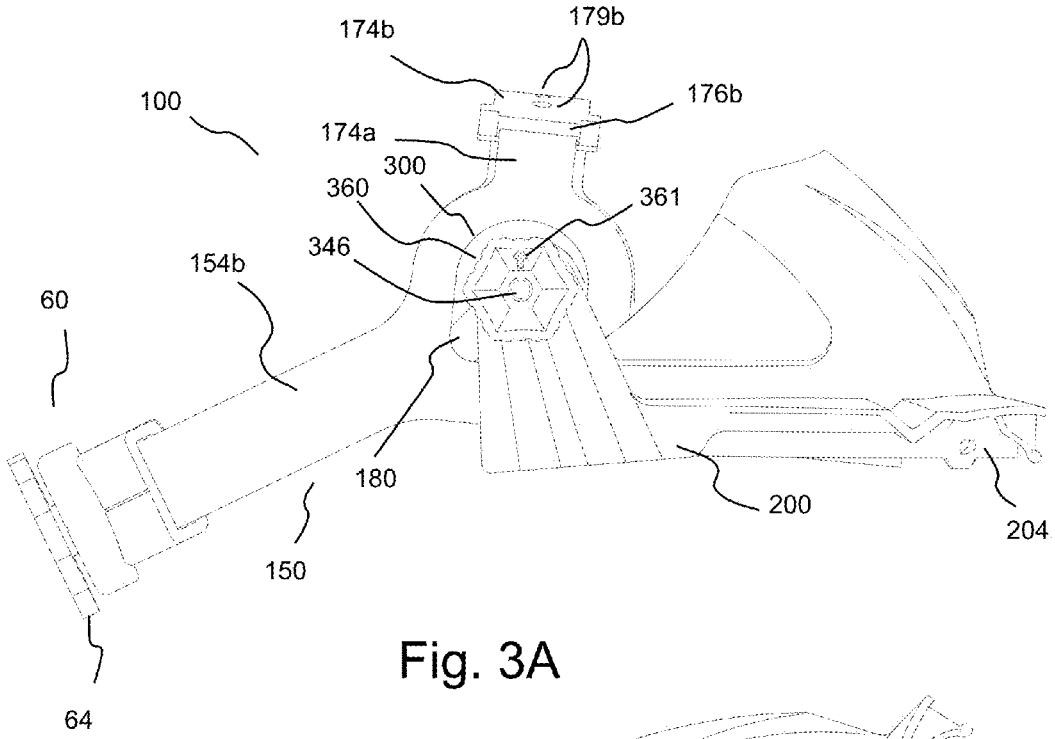
FIG. 3A illustrates a side view of the support system of FIG. 1 wherein the frame for supporting a face shield or visor is in a lowered position for use.
Figure 3B:
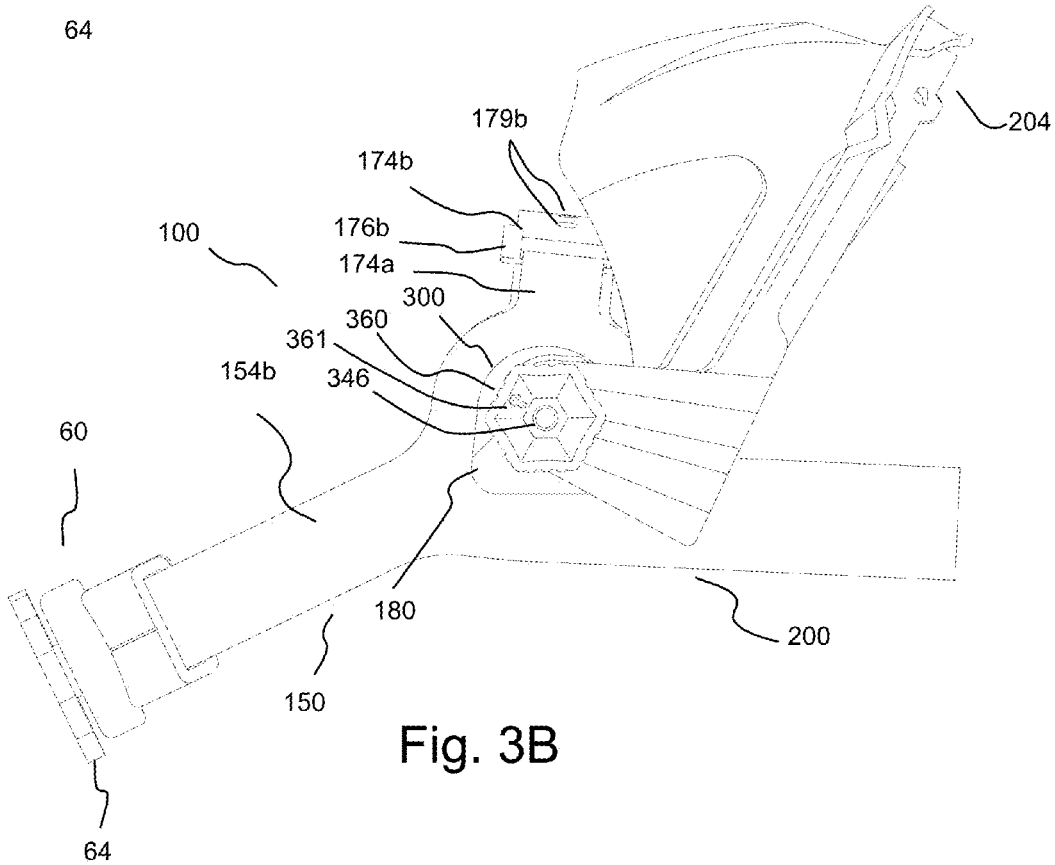
FIG. 3B illustrates a side view of the support system of FIG. 1 wherein the frame is in a raised position for stowing.
Figure 3C:
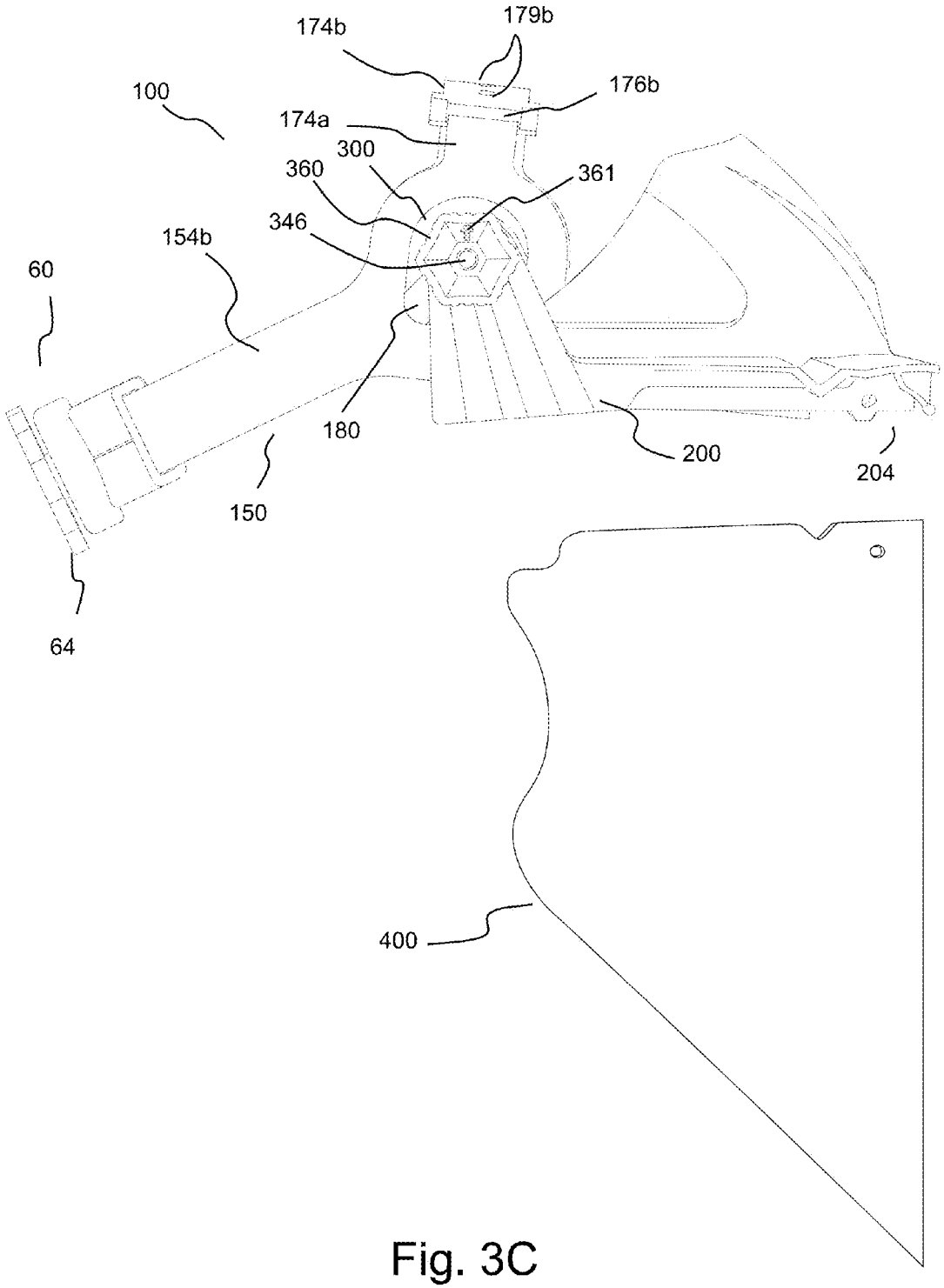
FIG. 3C illustrates a side view of the support system of FIG. 1 wherein the frame is in a lowered position for use, and a face shield or visor is in position for attachment to the frame.

FIGS. 1 through 5F illustrate an embodiment of a support system 100 for use in supporting a face shield or visor 400 (see FIG. 3C). Support system 100 includes headwear or a headwear system to be worn on the head of the user. In the illustrated embodiment, support system 100 includes a suspension system 150 (that is adjustable to fit the head of a user) to suspend support system 100 thereon. In other embodiments, support systems hereof may, for example, include a helmet or other headwear that is worn by a user. In the illustrated embodiment, suspension system 150 includes a first strap 154*a* and a second strap 154*b* that connect to extend generally latitudinally around the head of a user. In the illustrated embodiment, first generally latitudinally extending strap 154*a* and second generally latitudinally extending strap 154*b* are in cooperative connection with a ratcheting size adjustment mechanism 160 including an adjustment knob 164, which operates as described in U.S. Pat. No. 5,950,245, the disclosure of which is incorporated herein by reference. In a number of embodiments, turning adjustment knob 164 in a first direction (for example, clockwise) results in drawings first strap 154*a* and second strap 154*b* closer together, increasing an overlap thereof and tightening the fit of suspension system 150 around the head of a user. Turning adjustment knob 164 in a second direction (for example, counterclockwise) results in pushing first strap 154*a* and second strap 154*b* farther apart, decreasing an overlap thereof and loosening the fit of suspension system 150 around the head of a user. Suspension system 150 further includes a first generally longitudinally extending strap 174*a* and a second generally longitudinally extending strap 174*b* which cooperatively connect to extend around a top of a user's head. In the illustrated embodiment, first strap 174*a* passes through a buckle or retainer 176*b* of second strap 174*b* and includes at least one extending member 178*a* which cooperates with one of a plurality of passages or holes 179*b* in second strap 174*a* to adjustably connected first strap 174*a* to second strap 174*b*.

Support system 100 further includes a frame 200 that is pivotably connected to headwear system/suspension system 150 and supported upon the head of the user by suspension system 150 (or other headwear system). Visor or face shield 400 connects to frame 200, which is pivotable to a lowered position in which visor or face shield 400 is positioned to shield a user's eyes/face and to a raised position for stowing of visor or shield 400 when not required by the user. In several embodiments, at least one adjustment mechanism 300 is provided to enable selection and maintenance of a desired position for frame 200, and thereby, visor or face shield 400. In the illustrated embodiment, a generally identical adjustment mechanism 300 is provided on each lateral side of support system 100.

In a number of embodiments, frame 200 is pivotable or rotatable about a hub 310 (see, for example, FIG. 4A) which is attached to suspension system 150 via an extending member 180. In a number of embodiments, frame 200 includes (or has attached thereto) a collar 220 which pivots or rotates around an extending portion 311 of hub 310. In other embodiments, a hub may be attached to suspension system 150 and a cooperating collar may be attached to frame 200. An inner diameter of a seating 222 of collar 220 into which an extending section 311 of hub 310 extends may, for example, be slightly larger than the outer diameter of extending section 311 such that collar 220 is rotatable about extending section 311 of hub 310. In a number of embodiments, an outer surface of extending section 311 and seating 222 are tapered, angled or beveled. In that regard, the outer diameter of extending section 311 and the inner diameter of seating 222 decrease upon moving outward (that is, away from the head of the user).

An extending pivot member 340 extends through a passage 312 in hub 300 and through a passage 224 in collar 220 such that a radially inward projecting flange or shoulder 314 of hub 310 and a radially inward projecting flange or shoulder 226 of collar 220 are captured between axially spaced and radially outward extending first and second flanges 342 and 344 of extending pivot member 340. A portion of flange 226 may, for example, be deformed radially outward (away from and axis of collar 220) by second flange 344 such that when second flange 344 passes thereover, and flange 226 recovers/deforms radially inward, extending pivot member 340 locks into connection with collar 220 and hub 310 (see, for example, FIGS. 5D through 5F).

Extending pivot member 340 includes another or third radially extending flange 346 on an end thereof opposite the end upon which first flange 342 is formed. Radially outward extending third (or retaining) flange 346 cooperates with a radially inward extending flange or shoulder 362 of an adjustment knob 360. In that regard, extending pivot member 340 passes through a passage 364 formed in adjustment knob 360. Upon third flange 346 contacting the inner wall of passage 364, continued axial pressure on extending pivot member 340 causes third flange 346 to compress radially inward so that third flange 346 (which may, for example, be beveled) passes through passage 364 until passing shoulder 362. After flange 346 passes over or past flange or shoulder 362, flange 346 relaxes to a radially extended state and forms a retaining engagement with flange or shoulder 362. A number of other systems have used cantilevered flanges to form a snap fit with a cooperating flange of an adjustment knob. However, such snap fits are quite easily disengaged by, for example, application of a pulling force of 4 to 5 pounds to the adjustment knob. By press fitting (compression) of flange 346 through passage 364 into engagement with flange or shoulder 362, a force of at least 10 pounds, at least 20 pounds, at least 30 pounds or at least 40 pounds may be required to remove adjustment knob 360 from connection with extending pivot member 340 (and thereby the remainder of adjustable mounting system 300). In one embodiment, 40.7 pounds of pulling or tensile force was required to remove adjustment knob 360 from connection with extending pivot member 340. In that embodiment, adjustment knob 360 was reconnected with extending pivot member 340 (as described above) after removal of the connection. Subsequent to reconnection, a pulling force of 17.7 pounds was still required to remove adjustment knob 360 from connection with extending pivot member 340. Requiring a disconnection force of at least 10 pounds assists in preventing accidental disconnection (as may readily occur with a number of currently available systems).

Moreover, even if adjustment knob 360 were to be accidentally disconnected from extending pivot member 340, the remaining elements of adjustable mounting system 300 are maintained in connection as described above via the cooperation of radially inward projecting flange or shoulder 314 of hub 310 and a radially inward projecting flange or shoulder 226 of collar 220 with radially outward extending first and second flanges 342 and 344, respectively, of extending pivot member 340. This cooperation helps prevent further disassembly of adjustable mounting system 300 upon disconnection of adjustment knob 360 from extending pivot member 340 (and the associated difficulty in reassembly and/or loss of components as often occurs with currently available systems).

An extending pivot member such as extending pivot member 340 (which, for example includes retainers such as first and second flanges 342 and 344 and/or third flange 346) may be used in connection with adjustable mounting systems including a pivotable members other than collars and hubs as described herein. For example, an adjustable mounting system may include a first member attached to a headwear system and a second member attached to the frame, wherein the second member is pivotable relative to the first member so that the frame is pivotable relative to the headwear system. The first member and the second member may, for example, be generally cylindrical disks with generally flat, abutting surfaces. Many other types of first and second members may be used.

In the illustrated embodiment, adjustment knob 360 further includes threading 366 formed around passage 364 which cooperates with threading 348 formed around extending pivot member 340. By, for example, rotating adjustment knob in a clockwise direction, engagement of threading 366 with threading 348, brings an end 368 of adjustment knob 360 into abutting contact with an outward facing surface 228 of collar 220 and compresses an inward facing surface or seating 230 of collar 220 into abutting contact with an outward facing surface 311*a* of extending section 311 of hub 310. Compressing collar 220 into abutting contact with hub 310 and the resulting friction between collar 220 and hub 310 "tightens" or "locks" the position of frame 200 relative to suspension system 150 (for example, in the lowered or deployed position, the stowed position or any intermediate position). In the tightened or locked state of adjustable mounting system 300, it is very difficult to change the relative orientation of frame 200 and suspension system 150.

Collar 220 and extending section 311 may, for example, be tapered, angled of beveled, which may further facilitate a tightened, locked, nested state upon tightening of adjustment knob 360. In that regard, forcing the tapered inner wall of collar 220 against the tapered outer wall of extending member 311 of hub 310 provides a significant amount of surface area for frictional contact. Moreover, wedging may occur. The angle or taper of the inner wall of collar 220 and the surface of extending member 311 may, for example, be generally the same. In a number of embodiments, the surface of extending member 311 may have slightly greater angle than the inner diameter of collar 220. In a number of representative embodiments, the angle or taper of the inner diameter of collar 220 and the outer surface of extending member 311 are each in the range of 1 to 10 degrees or 1 to 5 degrees.

Counterclockwise rotation of adjustment knob 360 removes abutment end 368 of adjustment knob 360 from contact with collar 220 (placing adjustment knob 360 in an untightened or loosened state) and significantly reduces the force required to change the relative orientation of frame 200 and suspension system 150 (as compared to the tightened or locked state), thereby allowing adjustment of frame 200 thereof to another desired position. Once frame 200 is rotate to its new position, adjustment knob 360 may once again be tightened as described above to "lock" frame 200 in that position.

In a number of embodiments, even when adjustment knob 360 is in a loosened state (in which abutment end 368 of adjustment knob 360 does not contact surface 228 of collar 220), sufficient frictional contact is made between collar 220 and hub 310 that some force is required to pivot frame 200. In that regard, sufficient frictional contact is made so that frame 200 will retain its position (for example, over the range of possible positions thereof) under only its own weight. Further force must be applied to frame 200 cause pivoting or rotation relative to suspension system 150. Retainers such as first and second flanges 342 and 344 of extending pivot member 340 assist in maintaining suitable contact between collar 220 and hub 310 (or between other pivoting members) to provide resistance to relative motion therebetween.

Flange 346 may, for example, be sufficiently axially spaced from threading 348 on extending pivot member 340 so that adjustment knob 360 may be freely rotated even to the point that threading 366 disengages from threading 348. Even upon disengagement of threading 366 from threading 348, adjustment knob 360 remains connected to extending pivot member 340 via cooperation of flange 346 with flange or shoulder 362. Disengagement of threading 366 from threading 348 ensure that further turning of adjustment knob 360 in a loosening direction will not exert tension upon extending pivot member 340 which might lead to disengagement of knob 360 from extending pivot member 340.

In a number of embodiments, an axially extending seating or guide 370 (which may, for example, be generally annular in shape) cooperates with an axially extending guide flange 232 (which may, for example, be generally annular, cylindrical or tube-like in shape) to maintain the axis of adjustment knob 360 in general alignment with the axis of collar 220 and extending pivot member 340, thereby reducing wobbling about the axis of mounting system 300 and maintaining threading 366 in general alignment with threading 348 even if threading 366 is disengaged from threading 348. The axial alignment maintained as a result of cooperation of seating or guide 370 with axially extending guide flange 228 facilitates reengagement of threading 348 with threading 366 upon clockwise rotation of adjustment knob 360. Moreover, cooperation of annular guide 370 and annular or cylindrical guide flange 232 may assist in preventing debris from entering adjustable mounting system 300. Such debris may, for example, become attached to threading 348 and/or threading 366 and cause difficulty in adjusting the position of adjustment knob 360. In a number of embodiments, guide flange 232 was of sufficient length to remain in cooperative connection with seating 370 over the entire range of positions of adjustment knob 360.

In a number of embodiments, flange 344 (and or another element) of extending pivot member 340 cooperates with a seating 234 (and or another cooperating element) of collar 220 so that collar 220 cannot be rotated relative to extending pivot member 340 (and adjustment knob 360, when threading 348 is in threaded engagement with threading 366). In that regard, seating 234 and flange 344 (and/or other cooperating elements of extending pivot member 340 and collar 220) may have a shape other than a circular shape or may include a cooperating key/keyway engagement system. In a number of embodiments, flange 344 and seating 234 were hexagonal in shape. Requiring extending pivot member 340 and adjustment knob 360 to rotate with collar 220 may, for example, assist in preventing unintended loosening of adjustment knob 360 upon pivoting movement of collar 220/frame 200 relative to hub 310. Movement/pivoting of frame 200 relative to hub 310 may, for example, occur even when adjustment knob 360 is in a locked state upon, for example, bumping into an object. If, collar 220/frame 200 were allowed to rotate or pivot independent of the assembly of extending pivot member 340 and adjustment knob 360, one or more small rotations or pivots of collar 220/frame 200 relative to the assembly of extending pivot member 340 and adjustment knob 360 could result in loosening of knob 360 and relatively free pivoting or rotation of collar 220/frame 200 relative to hub 310. The rotation of adjustment knob 360 with rotation of collar 220/frame 200 is illustrated by the rotation of arrow 361 about the axis of adjustable mounting system 300 in FIGS. 3A and 3B.

In a number of embodiments, collar 220 and hub 310 were formed of a resilient polymeric material (for example, high density polyethylene). In a number of embodiments, collar 220 and frame 200 were form monolithically from a resilient polymeric material. In a number of embodiments, adjustable mechanism 360 and extending pivot member 340 were formed from a rigid polymeric material such as nylon 66 (a polyamide).

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A support system, comprising:

a headwear system adapted to be worn on the head of a user;

a frame adapted to have a visor attached thereto to shield at least a portion of the face of the user;

a first member attached to the headwear system;

a second member attached to the frame, the second member being pivotable relative to the first member so that the frame is pivotable relative to the headwear system;

an adjustable mechanism adapted to abut and apply force to the second member in a first state to compress the second member into abutting engagement with the first member and having at least a second state in which the adjustable mechanism does not abut the first member; and an extending pivot member extending axially through a passage in the first member and a passage in the second member, the pivot member comprising threading, the adjustable mechanism comprising cooperating threading via which the position of the adjustable mechanism may be adjusted to place it in the first state or in the at least a second state, the extending pivot member further comprising a first flange and a second flange, spaced from the first flange, the first flange and the second flange capturing a portion of the first member and a portion of the second member therebetween, thereby maintaining the extending pivot member, the first member and the second in operative connection.

2. The support system of claim 1 wherein the extending pivot member further comprises a third flange, wherein the threading of the extending pivot member is positioned between the third flange and the second flange, and the third flange cooperates with a portion of the adjustable mechanism to retain the adjustable mechanism in operative connection with the first member and the second member.

3. The support system of claim 2 wherein at least 10 pounds of force is required to separate the adjustable mechanism and the extending pivot member.

4. The support system of claim 3 wherein the adjustable mechanism comprises a passage through which the third flange of the extending pivot member is press fit to a position in which the third flange of the extending pivot member cooperates with a radially inward extending portion of the extending pivot member.

5. The support system of 2 wherein the third flange is positioned relative to the threading of the extending pivot member such that the cooperating threading of the adjustable mechanism can be removed from connection with the threading of the extending pivot member while the adjustable mechanism is retained in connection with the extending pivot member via cooperation of the third flange and a radially inward extending portion of the adjustable mechanism.

6. The support system of claim 1 wherein the first member comprises a guide member and the adjustable mechanism comprises a cooperating guide member such that the guide member cooperates with the cooperating guide member to maintain the adjustable mechanism in general axial alignment with the extending pivot member when the cooperating threading of the adjustable mechanism is removed from connection with the threading of the extending pivot member.

7. The support system of claim 6 wherein the guide member and the cooperating guide member are annular in shape.

8. The support system of claim 1 wherein the first member comprises a hub comprising an axially extending member and the second member comprises a collar, the collar extending around at least a portion of the axially extending member.

9. The support system of claim 8 wherein a surface of the axially extending member of the hub is angled, and an inner diameter of the collar is angled.

10. The support system of claim 1 wherein the first member and the second are maintained in operative connection via the extending pivot member such that force must be applied to the frame when the adjustable mechanism is in the second state to pivot the frame relative to the headwear system.

11. A support system, comprising:

a headwear system adapted to be worn on the head of a user;

a frame adapted to have a visor attached thereto to shield at least a portion of the face of the user;

a hub attached to one of the headwear system or the frame, the hub comprising an axially extending member;

a collar attached to the other of the headwear system or the frame, the collar extending around at least a portion of the axially extending member of the hub and being pivotable about the axis of the axially extending member of the hub; and an adjustable mechanism adapted to abut and apply force to one of the collar or the hub in a first state to compress the inner wall of the collar into abutting engagement with the axially extending member of the hub and having at least a second state in which the adjustable mechanism does not abut the collar or the hub.

12. The support system of claim 11 wherein the hub is attached to the headwear system such that the axially extending member of the hub extends axially outward and the collar is attached to the frame.

13. The support system of claim 11 wherein an outer surface of the axially extending member of the hub is angled and an inner diameter of the collar is angled.

14. The support system of claim 12 further comprising an extending pivot member extending axially through a passage in the hub and a passage in the collar, the extending pivot member comprising threading, the adjustable mechanism comprising cooperating threading via which the position of the adjustable mechanism may be adjusted to place it in the first state or in the at least a second state.

15. The support system of claim 14 wherein the extending pivot member comprises a first flange and a second flange, spaced from the first flange, the first flange and the second flange capturing a portion of the hub and a portion of the collar therebetween, thereby maintaining the extending pivot member, the hub and the frame in operative connection.

16. The support system of claim 15 wherein the extending pivot member further comprises a third flange, wherein the threading of the extending pivot member is positioned between the third flange and the second flange, and the third flange cooperates with a portion of the adjustable mechanism to retain the adjustable mechanism in operative connection with the hub and the frame.

17. The support system of claim 16 wherein at least 10 pounds of force is required to separate the adjustable mechanism and the extending pivot member.

18. The support system of claim 17 wherein the adjustable mechanism comprises a passage through which the third flange of the extending pivot member is press fit to a position in which the third flange of the extending pivot member cooperates with a radially inward extending portion of the extending pivot member.

19. The support system of 16 wherein the third flange is positioned relative to the threading of the extending pivot member such that the cooperating threading of the adjustable mechanism can be removed from connection with the threading of the extending pivot member while the adjustable mechanism is retained in connection with the extending pivot member via cooperation of the third flange and a radially inward extending portion of the adjustable mechanism.

20. The support system of claim 11 wherein the collar comprises a guide member and the adjustable mechanism comprises a cooperating guide member such that the guide member cooperates with the cooperating guide member to maintain the adjustable mechanism in general axial alignment with the collar when the cooperating threading of the adjustable mechanism is removed from connection with the threading of the extending pivot member.

21. The support system of claim 20 wherein the guide member and the cooperating guide member are annular in shape.

22. The support system of claim 15 wherein the extending pivot member comprises an element that abuts with a cooperating element of the collar so that the pivot member pivots with the frame.

23. The support system of claim 22 wherein the element of the extending pivot member is the second flange, the second flange has a noncircular shape, and the cooperating element is a seating of the collar which has a noncircular shape.

24. The support system of claim 11 wherein the first member and the second are maintained in operative connection via the extending pivot member such that force must be applied to the frame when the adjustable mechanism is in the second state to pivot the frame relative to the headgear system.

25. A support system, comprising:

a headwear system adapted to be worn on the head of a user;

a frame adapted to have a visor attached thereto to shield at least a portion of the face of the user;

a first member attached to the headwear system;

a second member attached to the frame, the second member being pivotable relative to the first member so that the frame is pivotable relative to the headwear system;

an adjustable mechanism adapted to abut and apply force to the second member in a first state to compress the second member into abutting engagement with the first member and having at least a second state in which the adjustable mechanism does not abut the first member; and an extending pivot member extending axially through a passage in the first member and a passage in the second member, the extending pivot member comprising threading, the adjustable mechanism comprising cooperating threading via which the position of the adjustable mechanism may be adjusted to place it in the first state or in the at least a second state, the extending pivot member further comprising a retaining flange that cooperates with a portion of the adjustable mechanism to retain the adjustable mechanism in operative connection with the extending pivot member;

the adjustable mechanism comprising a passage through which the retaining flange is press fit to a position in which the retaining flange of the extending pivot member cooperates with a radially inward extending portion of the extending pivot member.

26. The support system of claim 25 wherein at least 10 pounds of force is required to separate the adjustable mechanism and the extending pivot member.

* * * * *